US010191413B1

(12) United States Patent
Chuang et al.

(10) Patent No.: US 10,191,413 B1
(45) Date of Patent: Jan. 29, 2019

(54) TONER CARTRIDGE

(71) Applicant: GENERAL PLASTIC INDUSTRIAL CO., LTD., Taichung (TW)

(72) Inventors: Chin-His Chuang, Taichung (TW); Chi-Chin Huang, Taichung (TW)

(73) Assignee: GENERAL PLASTIC INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 15/902,284

(22) Filed: Feb. 22, 2018

(30) Foreign Application Priority Data

Sep. 1, 2017 (TW) ..... 106129926 A

(51) Int. Cl.
*G03G 15/08* (2006.01)

(52) U.S. Cl.
CPC ..... *G03G 15/0891* (2013.01); *G03G 15/0872* (2013.01); *G03G 15/0886* (2013.01); *G03G 2215/0668* (2013.01)

(58) Field of Classification Search
CPC ..... G03G 15/0891
See application file for complete search history.

(56) References Cited

U.S. PATENT DOCUMENTS

2009/0185824 A1* 7/2009 Murakami ..... G03G 15/0896 399/120
2011/0064482 A1* 3/2011 Ishiguro ..... G03G 15/0875 399/263
2013/0101318 A1* 4/2013 Shimizu ..... G03G 15/0868 399/258
2014/0140736 A1* 5/2014 Miyamoto ..... G03G 15/0877 399/258
2015/0338825 A1* 11/2015 Leemhuis ..... F16D 1/06 403/348

* cited by examiner

*Primary Examiner* — Clayton E. LaBalle
*Assistant Examiner* — Jas A Sanghera
(74) *Attorney, Agent, or Firm* — Muncy, Geissler, Olds & Lowe, P.C.

(57) ABSTRACT

A toner cartridge for accommodating toners includes a barrel, a transmission member and a toner conveying shaft. The barrel is adapted for accommodating toners and provided at an end thereof with an opening. The transmission member is rotatably disposed at the end of the barrel. The toner conveying shaft is rotatably disposed inside the barrel and provided with a shaft portion and at least one scoop portion extending from the shaft portion in a way that the scoop portion conveys the toners from the barrel to the transmission member when the toner conveying shaft rotates relative to the barrel. As a result, the toners inside the barrel can be continuously discharged out via the scoop portion.

14 Claims, 10 Drawing Sheets

TONER CARTRIDGE

BACKGROUND OF THE INVENTION

1. Field of the Invention

The present invention relates generally to an electronic image-forming apparatus and more particularly, to a toner cartridge used in the electronic image-forming apparatus.

2. Description of the Related Art

With continual and flourishing development of informatization of global industrial, electronic and information products have brought people a quick and convenient life. In an era of informatization, an electronic image-forming apparatus, such as photocopier, printer, fax machine, etc., which can print digital documents, photos and drawings into paper form or duplicate documents, is an important product.

The electronic image-forming apparatus can produce a duplicate copy of an original document, such as handwriting paper, printing material or drawing. With the modernized characteristic of fast copying document, the electronic image-forming apparatus saves time for transcription, handwriting and duplication. In another aspect, a toner cartridge is one of the important structural devices of the electronic image-forming apparatus, and also a technical core for achieving image developing. Though there are various toner cartridges with different structures commercially available to consumers, the goal of perfectly making the toner cartridge with more functions, such as a function that can almost completely discharge toners out of the toner cartridge, is still to be reached by manufactures.

SUMMARY OF THE INVENTION

The present invention has been accomplished in view of the above-noted circumstances. It is an objective of the present invention to provide a toner cartridge capable of discharging toners out and reducing the residual quantity of the toners remained therein.

To attain the above objective, the present invention provides a toner cartridge for accommodating toners therein, comprising a barrel, a transmission member and a toner conveying shaft. The barrel is adapted for accommodating toners and provided at an end thereof with an opening. The transmission member is rotatably disposed at the end of the barrel. The toner conveying shaft is rotatably disposed inside the barrel and provided with a shaft portion and at least one scoop portion extending from the shaft portion in a way that the scoop portion conveys the toners from the barrel to the transmission member when the toner conveying shaft rotates relative to the barrel. As a result, the toners contained inside the barrel can be continuously conveyed out via the scoop portion, thereby effectively discharging the toners out of the toner cartridge so as to reduce the residual amount of the toners remained inside the barrel.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
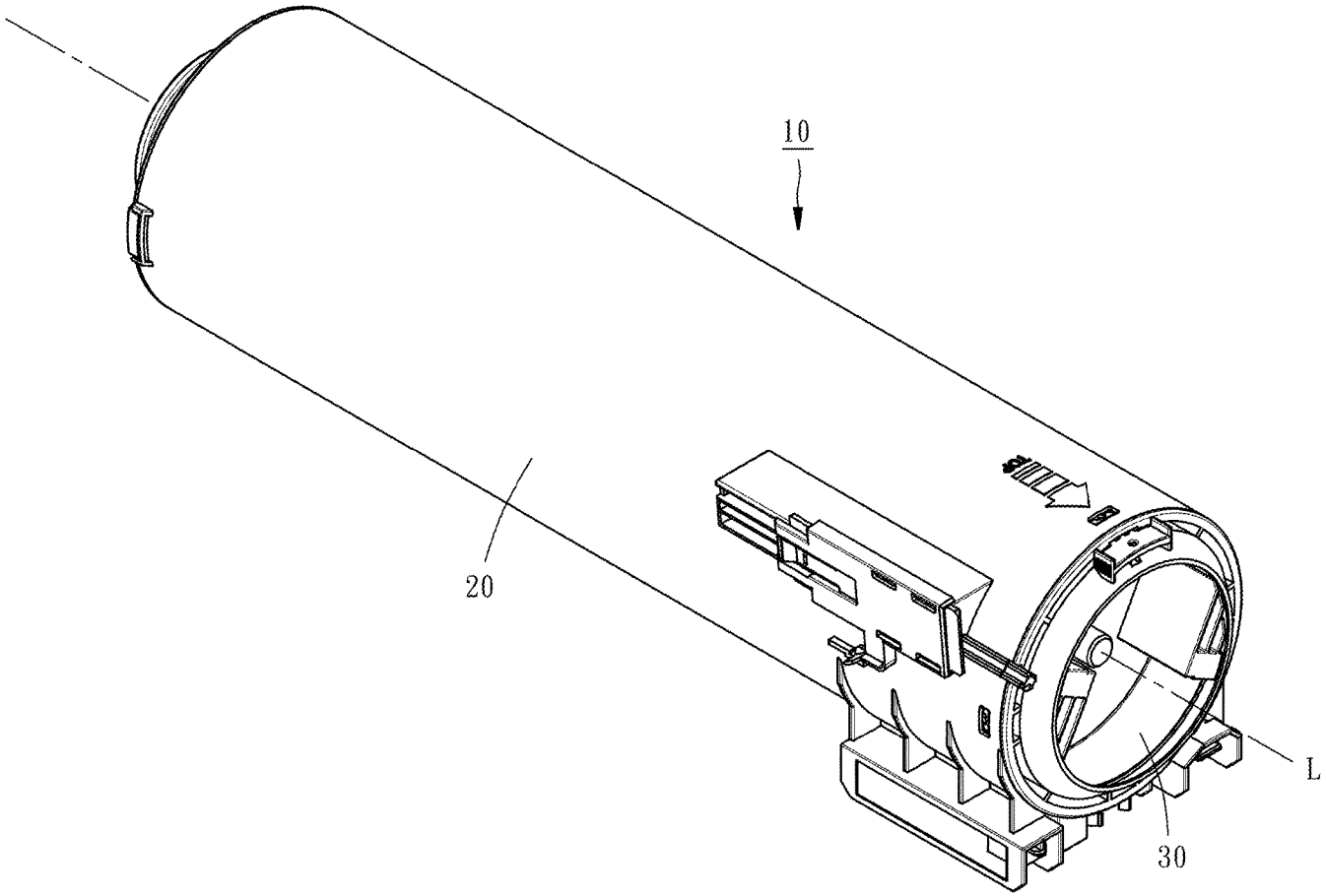
FIG. 1 is a perspective view of a toner cartridge according to a first embodiment of the present invention.
Figure 2:
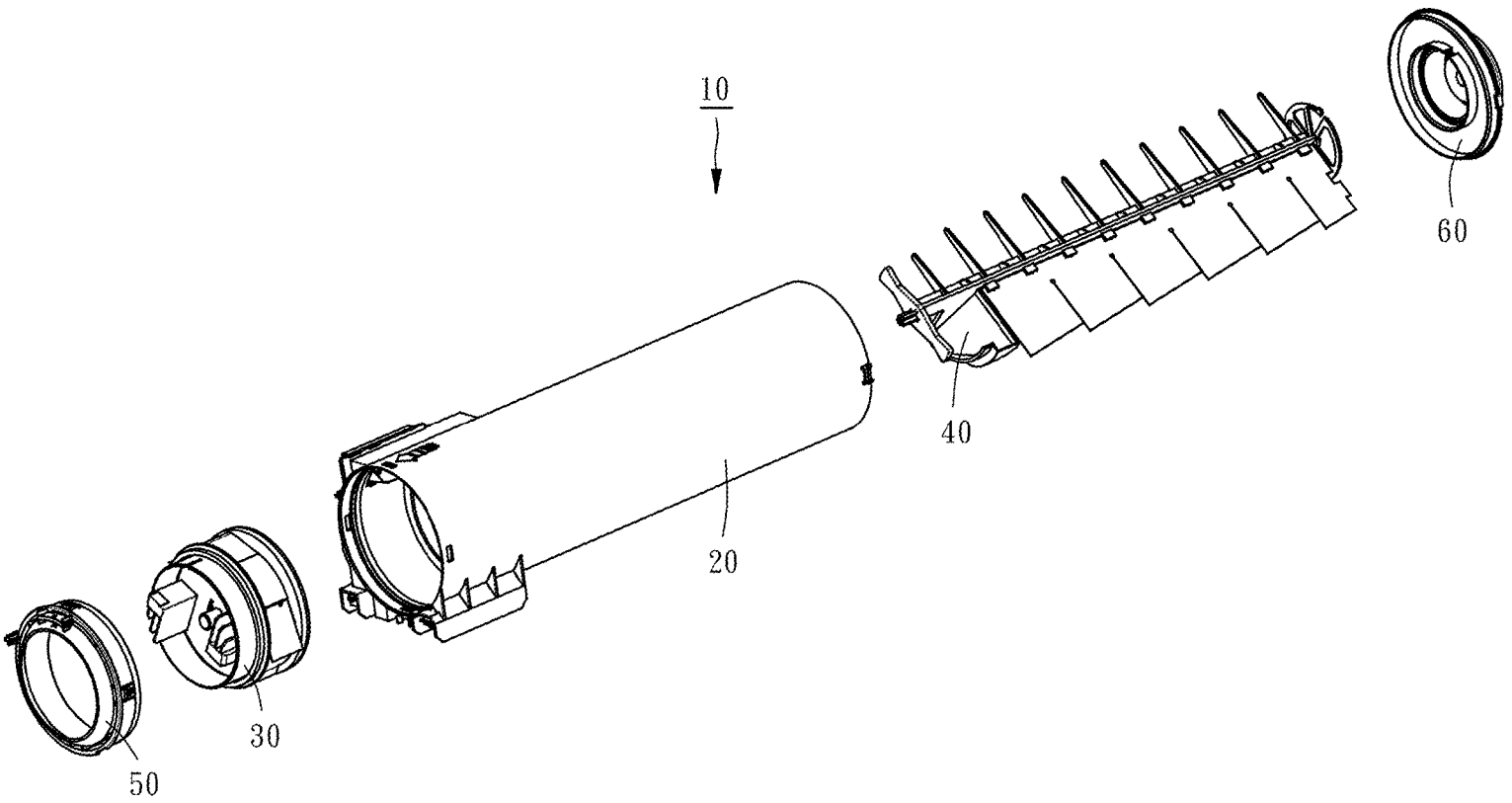
FIG. 2 is an exploded view of the toner cartridge according to the first embodiment of the present invention.

FIGS. 1 and 2 show a toner cartridge 10 for accommodating toners in accordance with a first embodiment of the present invention. The toner cartridge 10 is composed of a barrel 20, a transmission member 30, a toner conveying shaft 40, a head cover 50 and a tail cover 60. The toner cartridge 10 can define an imaginary center line L axially passing through a center of the toner cartridge 10.

Figure 3:
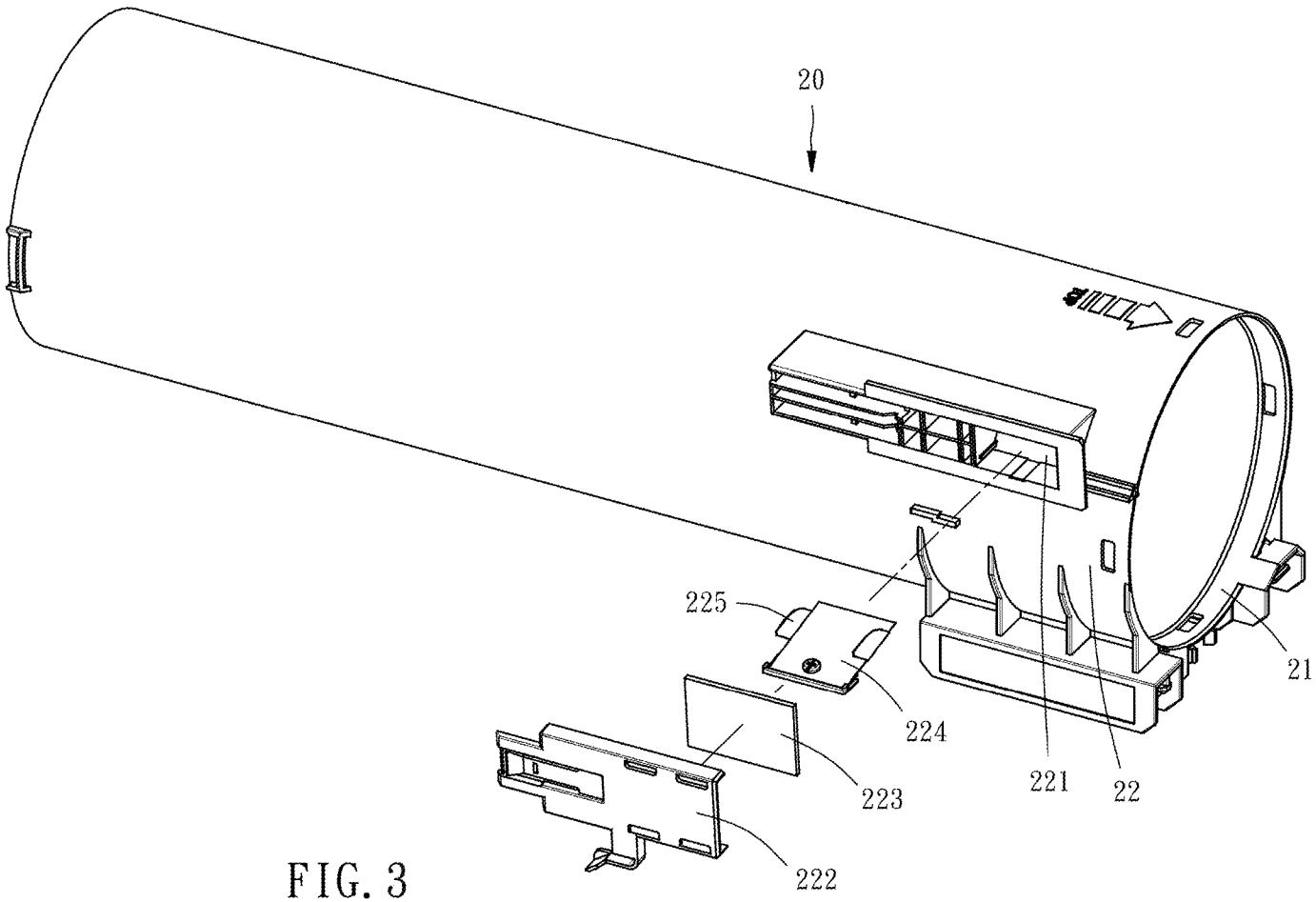
FIG. 3 is an exploded view of a barrel of the toner cartridge according to the first embodiment of the present invention.
Figure 4:
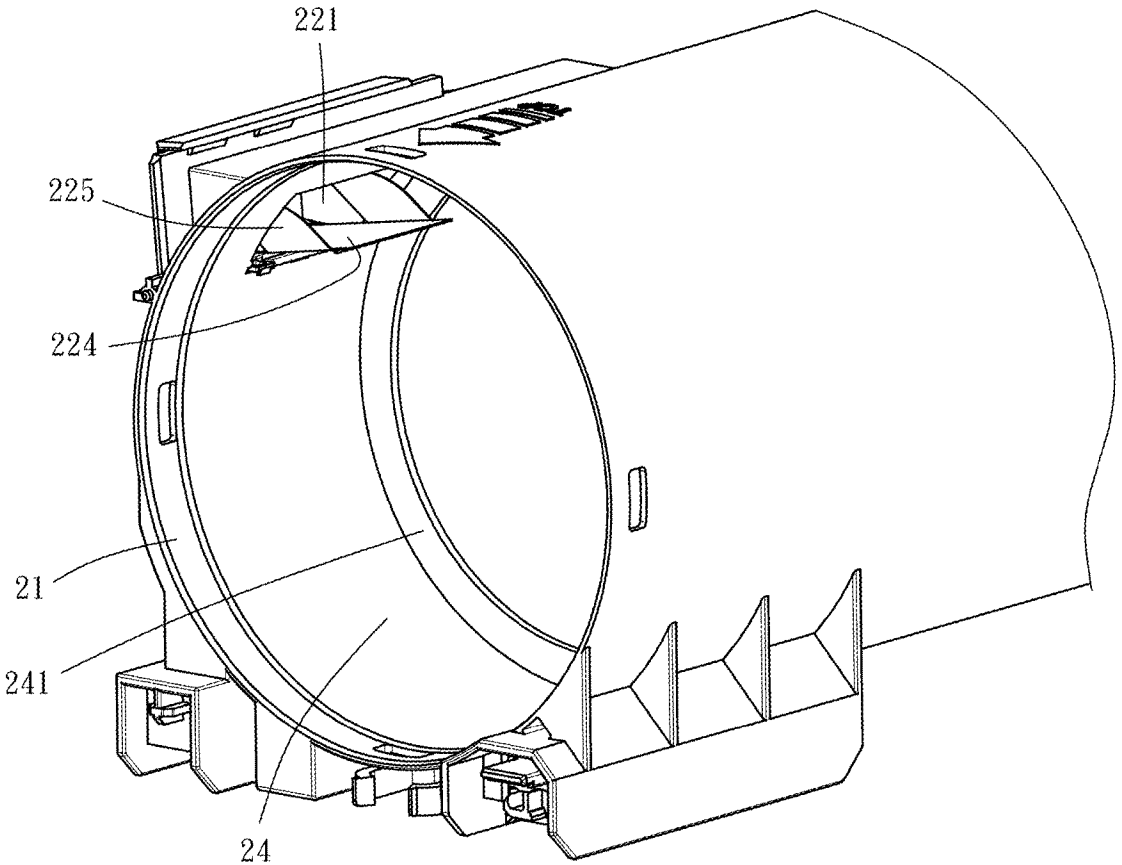
FIG. 4 is a partially perspective view of the barrel of the toner cartridge according to the first embodiment of the present invention.

The barrel 20 is adapted for accommodating toners therein. Referring to FIGS. 3 and 4, the barrel 20 is provided at an end thereof with an opening 21, and at a lateral periphery 22 thereof with a toner exit 221. A slider piece 222, on which a sealing member 223 is disposed, is slidably disposed over the toner exit 221 and slidably moveable between a closed position where the sealing member 223 blocks the toner exit 221, and an opened position where the sealing member 223 departs from the toner exit 221. A toner guiding member 224 is disposed at a bottom edge of the toner exit 221. The toner guiding member 224 is provided at each of two lateral sides thereof with a toner guiding sheet 225 for guiding and collecting toner. The barrel 20 is provided at an internal periphery 24 thereof with a limit ring 241. The toner exit 221 is located between the opening 21 and the limit ring 241.

Figure 5:
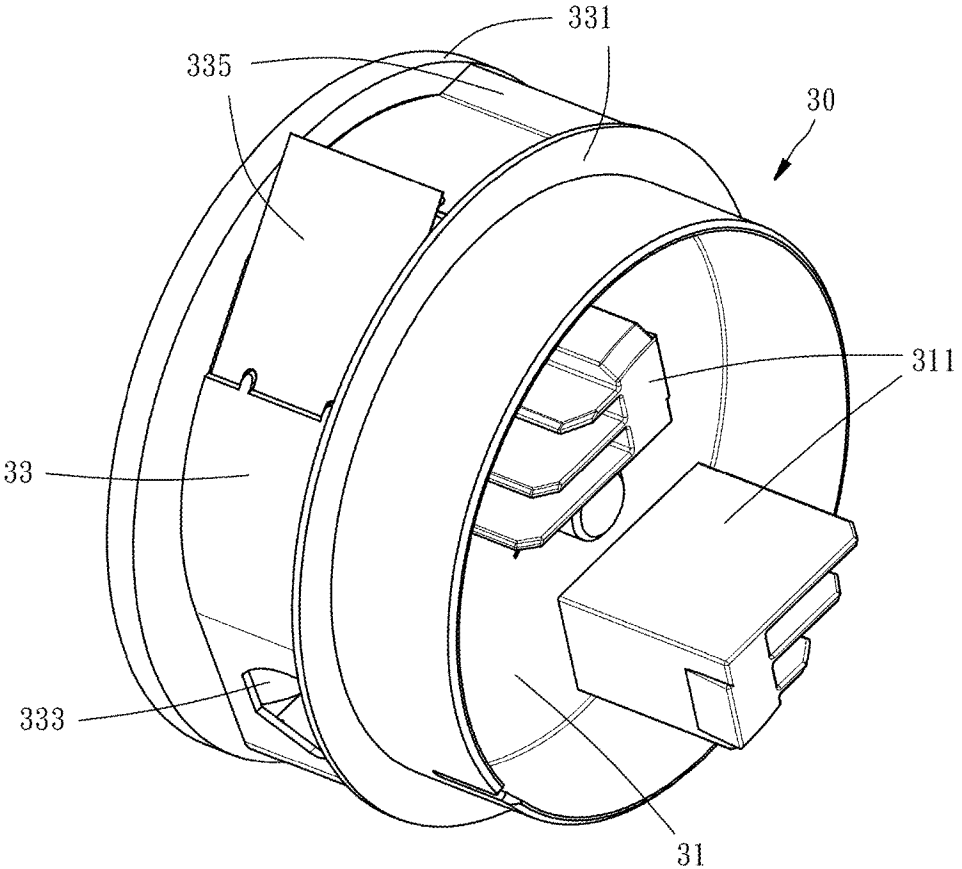
FIG. 5 is a perspective view of a transmission member of the toner cartridge according to the first embodiment of the present invention.
Figure 6:
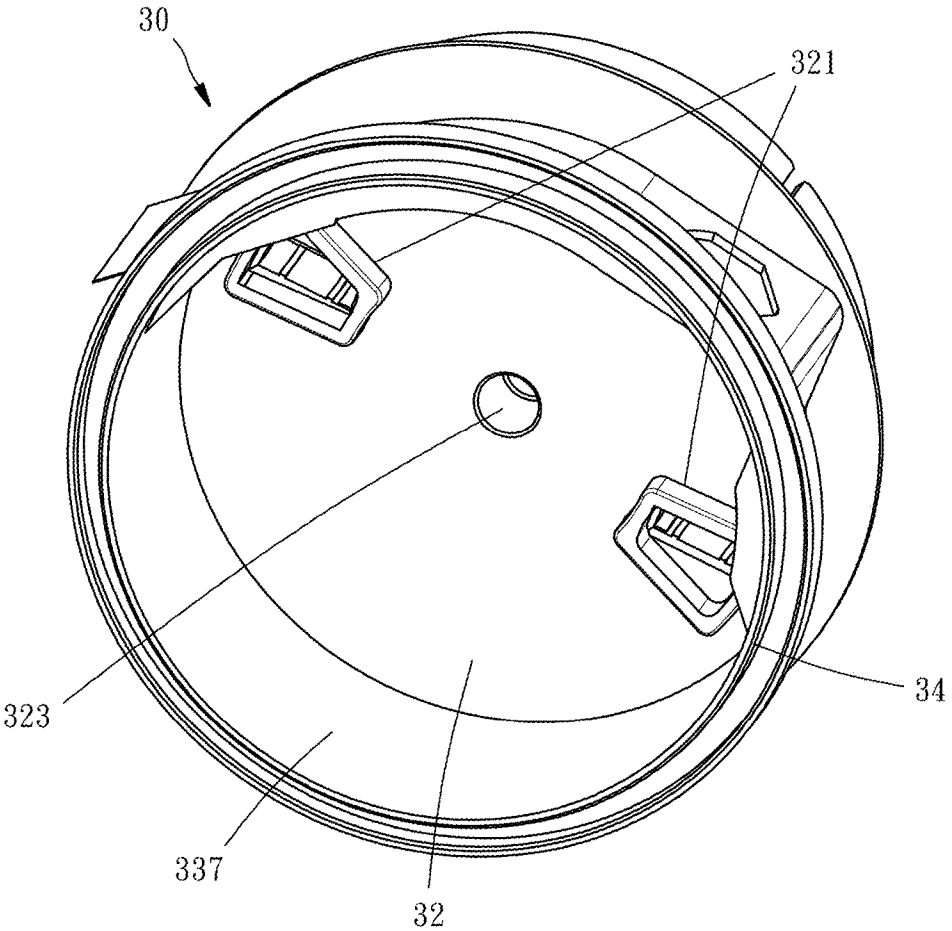
FIG. 6 is another perspective view of the transmission member of the toner cartridge according to the first embodiment of the present invention.

Referring to FIGS. 5 and 6, the transmission member 30 is rotatably disposed to an end of the barrel 20 and blocks the opening 21 of the barrel 20. An outer side 31 of the transmission member 30 is provided with two outer drive portions 311, and an inner side 32 of the transmission member 30 is provided with two inner drive portions 321 and an axle coupling portion 323. A lateral periphery 33 of the transmission member 30 is provided with two protrusion rings 331, an outlet 333 between the two protrusion rings 331, and two resilient pieces 335 between the two protrusion rings 331. After the transmission member 30 is assembled with the barrel 20, the two protrusion rings 331 abut against the internal periphery 24 of the barrel 20, the toner exit 221 of the barrel 20 is located between the two protrusion rings 331, a distal end of the toner guiding member 224 extends into a space between the two protrusion rings 331, and an inner lateral edge 34 of the transmission member 30 abuts against the limit ring 241 of the barrel 20, such that transmission member 30 is restricted by the limit ring 241 and will not move toward an inside of the barrel 20. The lateral periphery 333 of the transmission member 30 defines an inner lateral space 337 in communication with the inside of the barrel 20.

Figure 7:
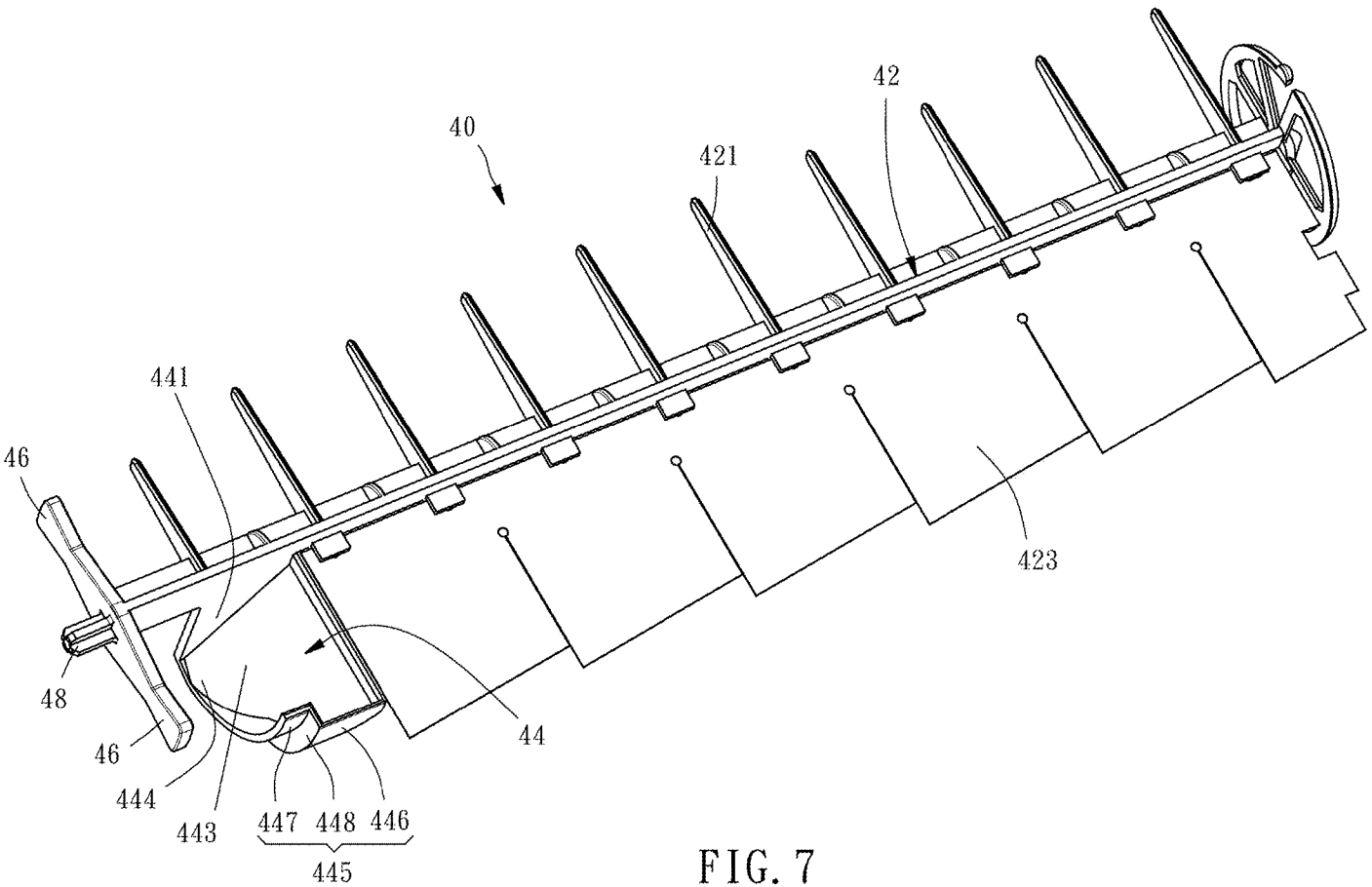
FIG. 7 is a perspective view of a toner conveying shaft of the toner cartridge according to the first embodiment of the present invention.
Figure 8:
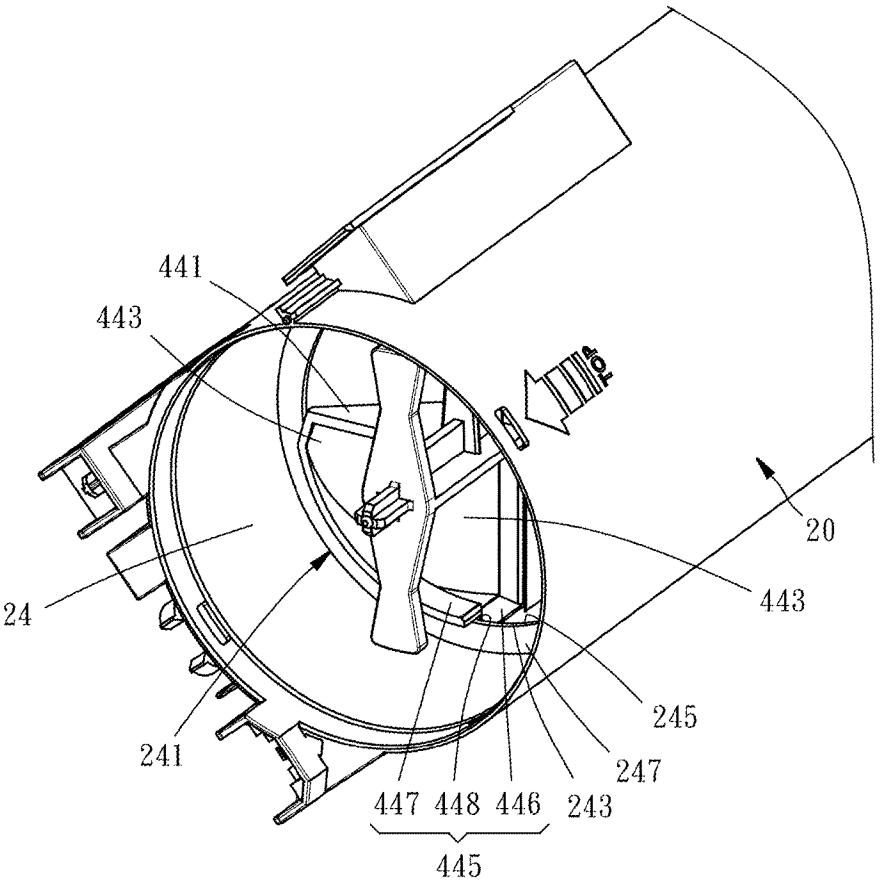
FIG. 8 is a partially perspective view, showing that the toner conveying shaft of the toner cartridge according to the first embodiment of the present invention is installed with barrel.

Referring to FIGS. 7 and 8, the toner conveying shaft 40 is rotatably disposed inside the barrel 20 and provided with a shaft portion 42 and a scoop portion 44 extending from the shaft portion 42. When the toner conveying shaft 40 is rotated relative to the barrel 20, the scoop portion 44 is also rotated about the imaginary center line L relative to the barrel 20 so as to convey toners from the barrel 20 to the transmission member 30. In this embodiment, the toner conveying shaft 40 has an end provided with two radially extending driven portions 46 and a protrusion axle 48 protruding between the two radially extending driven portions 46. The protrusion axle 48 is inserted through the axle coupling portion 323 of the transmission member 30, such that the toner conveying shaft 40 and the transmission member 30 are arranged in a coaxial manner and the toner conveying shaft 40 is rotatable relative to the transmission member 30 to an extent that the two driven portions 46 are abutted with the inner drive portions 321 and then can be rotated relative to the barrel 20 along with the transmission member 30. The shaft portion 42 of the toner conveying shaft 40 is provided with a plurality of stir rods 421 for stirring toners, and a conveying blade 423 for moving the toners inside the barrel 20 toward the opening 21. In other feasible embodiments, the toner conveying shaft 40 may include a plurality of conveying blades 423.

The scoop portion 44 of the toner conveying shaft 40 includes a supporting wall 441 extending radially from the shaft portion 42, an inclined guiding wall 443 extending from the supporting wall 441, and a curved stair wall 445 laterally extending from the end edge of the inclined guiding wall 443. An end of the supporting wall 441, namely the distal end that is remote from the shaft portion 42, is located by an outer side 247 of the limit ring 241 and extends into the inner lateral space 337 of the transmission member 30. The inclined guiding wall 443 has an end portion 444 located by the outer side 247 of the limit ring 241 and extending into the inner lateral space 337 of the transmission member 30. The curved stair wall 445 has a big diameter section 446, a small diameter section 447, and a connecting section 448. An end edge of the big diameter section 446 is located adjacent to and almost in contact with the internal periphery 24 of the barrel 20, and the small diameter section 447 is located adjacent to and almost in connect with the internal periphery 243 of the limit ring 241 and connected with the end portion 444 of the inclined guiding wall 443 in a way that a part of the small diameter section 447 is located by the outer side 247 of the limit ring 241. The connecting section 448 is connected between the big diameter section 446 and the small diameter section 447 and contacted with an inner side 245 of the limit ring 241.

The head cover 50 is disposed at an end of the barrel 20 to limit and hold the transmission member 30 in position so as to prevent the transmission member 30 from escape from the barrel 20. The tail cover 60 is disposed at the other end of the barrel 20 and connected with the toner conveying shaft 40.

When the toner cartridge 10 is installed into an image-forming apparatus, such as a copy machine, the two outer drive portions 311 of the transmission member 30 will be driven by a driving member (not shown) of the image-forming apparatus to cause the transmission member 30 to rotate, and meanwhile the two inner drive portions 321 rotate and then contact and push the two driven portions 46 to rotate synchronously, such that the toner conveying shaft 40 is driven by the transmission member 30 to rotate about the imaginary center line L relative to the barrel 20. In this way, the toners contained inside the barrel 20 will be moved by the rotary toner conveying shaft 40 toward the opening 21. When the toners reach to a place adjacent to the inner side 245 of the limit ring 241, the rotary scoop portion 44 will scoop up the toners. Specifically, because the end edge of the big diameter section 446 is located adjacent to the internal periphery 24 of the barrel 20, the toners located by the inner side 245 of the limit ring 241 and inside the barrel 20 will be taken into the scoop portion 44 through the big diameter section 446. With continuous rotation of the scoop portion 44, the tonners will be moved toward the supporting wall 441 along the inclined guiding wall 443 and also moved to the small diameter section 447. Because the end portion 444 of the inclined guiding wall 443 is located by the outer side 247 of the limit ring 241 and extends into the inner lateral space 337 of the transmission member 30, and the small diameter section 447 is connected with the end portion 444 of the inclined guiding wall 443, the toners will be conveyed into the transmission member 30 from the end portion 444 of the inclined guiding wall 443 and the small diameter section 447. Thereafter, the toners are discharged to a space between the two protrusion rings 331 via the outlet 333 of the lateral periphery 33 of the transmission member 30, and then brought by the two resilient pieces 335, which rotate along with the transmission member 30, to the toner guiding member 224 from the space between the two protrusion rings 331, and finally discharged out of the toner cartridge 10 via the toner exit 221. As a result, the toners inside the barrel 20 can be continuously taken out by the scoop portion 44 without being blocked by the limit ring 241, thereby facilitating discharging the toners out of the barrel 20 so as to reduce the residual amount of the toners remained inside the barrel 20.

Based on the technical features of the present invention, various modifications to the structure of the toner cartridge 10 of the present invention may be made. For example, one or more scoop portions 44 can be provided and the structure of the scoop portion 44 is not limited to the one disclosed in this embodiment as long as the scoop portion 44 can deliver the toners from the barrel 20 to the transmission member 30. Further, the limit ring 241 on the internal periphery 24 of the barrel 20 can be omitted, and in this way the transmission member 30 still cannot move toward the inside of the barrel 20 because the protrusion axle 48 of the toner conveying shaft 40 is inserted through the axle coupling portion 323 of the transmission member 30. Furthermore, the structure of the lateral periphery 33 of the transmission member 30 is not limited to the one disclosed in this embodiment as long as the transmission member 30 has the outlet 333, through which the toners can pass. Moreover, any structure that is helpful for aiding the toners to leave the toner cartridge 10 can be modified in accordance with any requirement. Therefore, it can be understood that the two resilient pieces 335 and/or the toner guiding member 224 can be omitted or can be provided at other places. The connecting way between the toner conveying shaft 40 and the transmission member 30 and the relevant structures thereof can be modified in accordance with any requirement. For example, one or more inner drive portions 321, driven portions 46 or outer drive portions 311 can be provided in the toner cartridge 10. Alternatively, the toner conveying shaft 40 can be driven by other structures or driving members, and the transmission member 30 can be configured not to completely block the opening 21.

Figure 9:
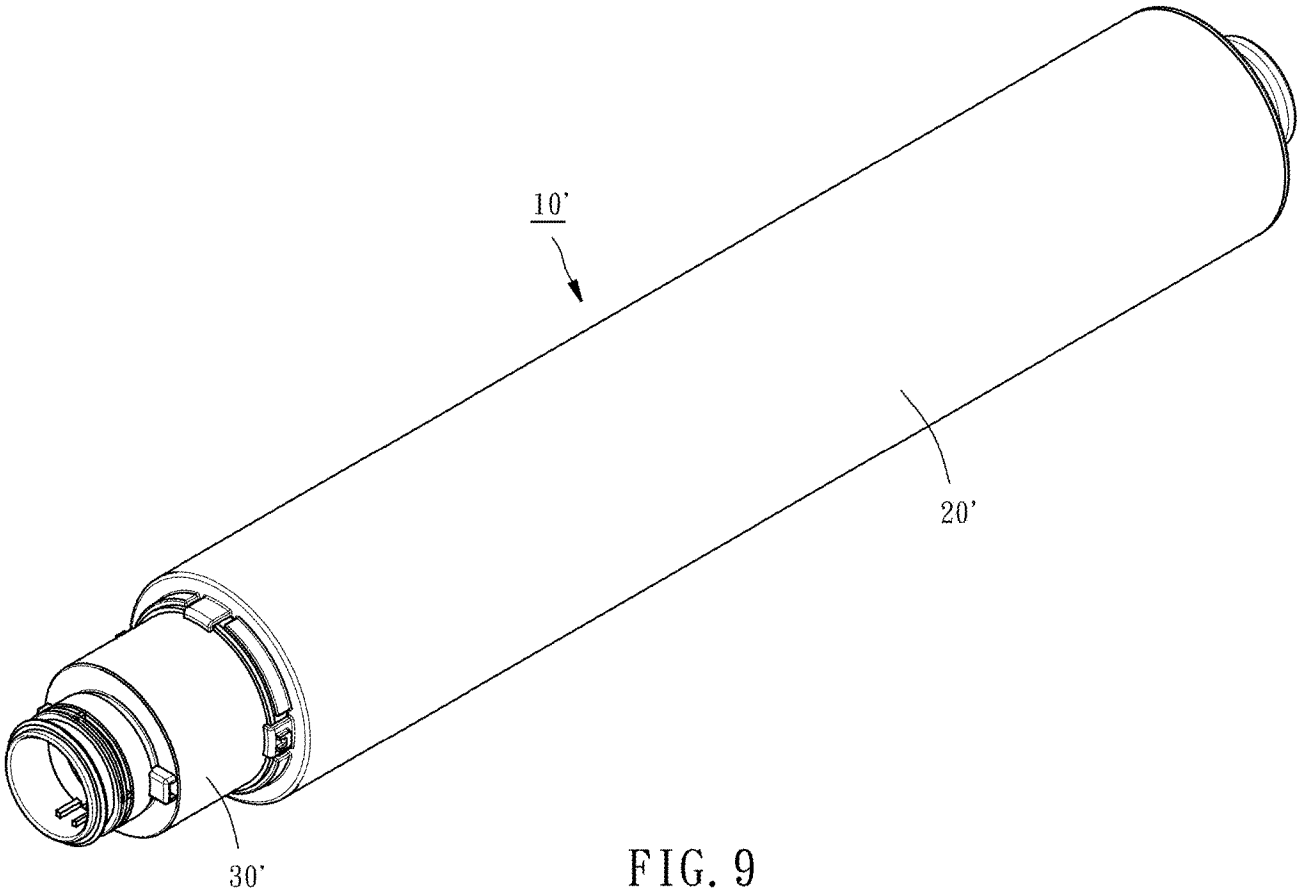
FIG. 9 is a perspective view of a toner cartridge according to a second embodiment of the present invention.
Figure 10:
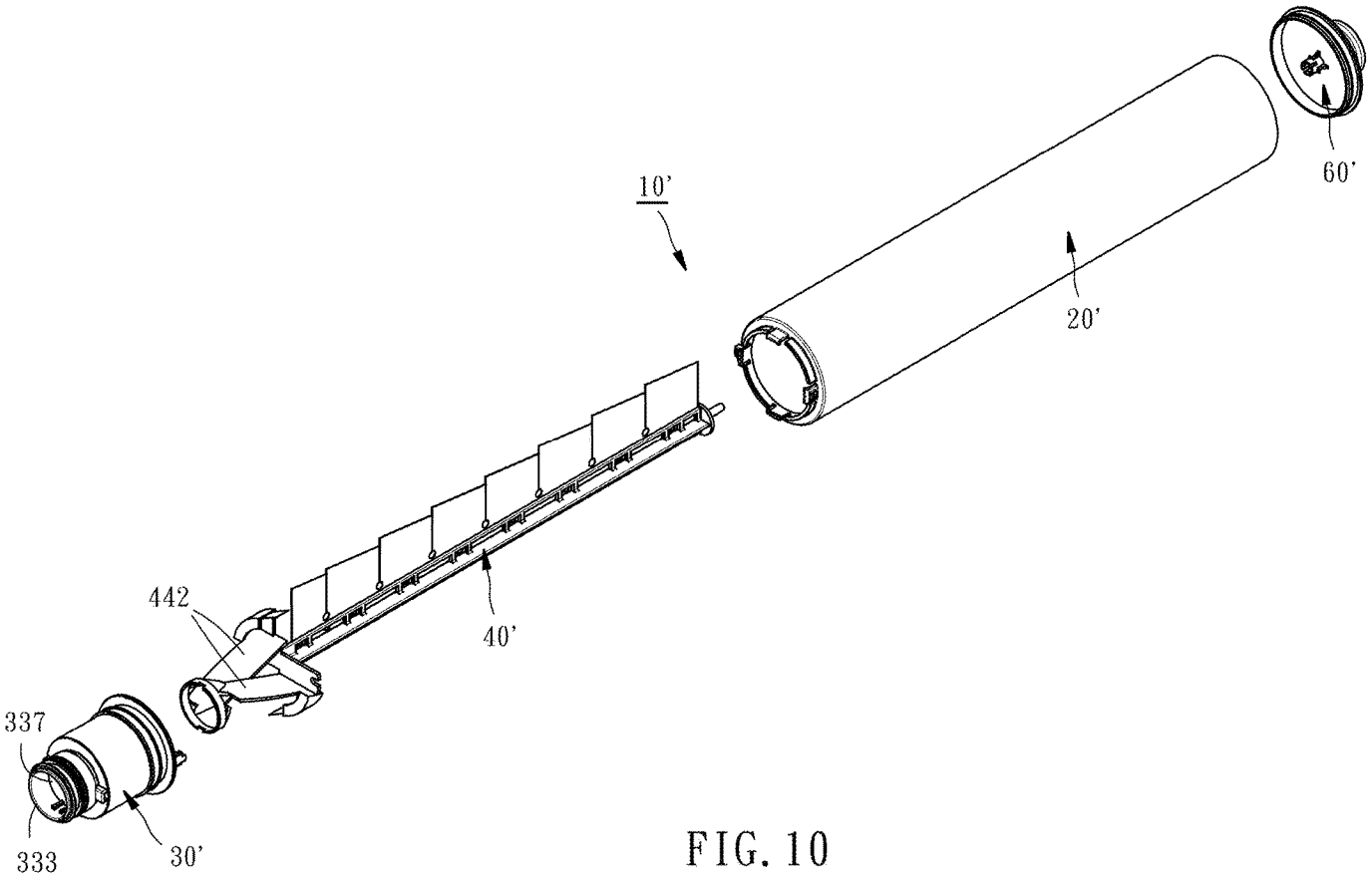
FIG. 10 is an exploded view of the toner cartridge according to the second embodiment of the present invention.

FIGS. 9 and 10 show a toner cartridge 10' in accordance with a second embodiment of the present invention. The toner cartridge 10' is composed of a barrel 20', a transmission member 30', a toner conveying shaft 40', and a tail cover 60'. The functions of the aforesaid elements in this embodiment are basically same as that of the corresponding elements in the first embodiment, and the structures thereof are however partially different. For example, the barrel 20' is provided with no such limit ring 241, and the outlet 333 of the transmission member 30' is located at an end of the transmission member 30'. The internal periphery of the transmission member 30' defines the inner lateral space 337, into which an end of the toner conveying shaft 40' extends. Further, the transmission member 30' has no such protrusion rings 331, and the scoop portion 44' of the toner conveying shaft 40' is different form the scoop portion 44 of the first embodiment in that the scoop portion 44' has two inclined guiding walls 442 and an included angle is contained between the two extending directions of the two inclined guiding walls 442. In this way, the two inclined guiding walls 442 can effectively convey the toners inside the barrel 20' to the transmission member 30', and then the toners can be discharged out of the toner cartridge 10' via the outlet 333 of the transmission member 30'. From the toner cartridges 10, 10' of the first and second embodiments, it can be understood that the structures of the toner conveying shafts 40, 40' and the structures of the corresponding barrels 20, 20' or transmission member 30, 30' can be modified in other feasible embodiments as long as the scoop portions 44, 44' can convey the toners from the barrels 20, 20' to the transmission members 30, 30'.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner cartridge for accommodating toners, the toner cartridge comprising:

a barrel for accommodating the toners, the barrel having an end with an opening;

a transmission member rotatably disposed at the end of the barrel; and a toner conveying shaft rotatably disposed inside the barrel and provided with a shaft portion and at least one scoop portion extending from the shaft portion in a way that the scoop portion conveys the toners from the barrel into the transmission member when the toner conveying shaft rotates relative to the barrel.

2. The toner cartridge as claimed in claim 1, wherein the barrel is provided at an internal periphery with a limit ring and at a lateral periphery with a toner exit located between the opening and the limit ring; the transmission member has an inner lateral edge abutting against the limit ring of the barrel.

3. The toner cartridge as claimed in claim 2, wherein the scoop portion of the toner conveying shaft comprises a supporting wall extending radially from the shaft portion, an inclined guiding wall extending from the supporting wall, and a curved stair wall laterally extending from an end edge of the inclined guiding wall; the curved stair wall has a big diameter section, a small diameter section, and a connecting section; an end edge of the big diameter section is located adjacent to the internal periphery of the barrel, and the small diameter section is located adjacent to an internal periphery of the limit ring; the connecting section is connected between the big diameter section and the small diameter section and contacted with an inner side of the limit ring.

4. The toner cartridge as claimed in claim 3, wherein the transmission member comprises a lateral periphery defining an inner lateral space communicated with an inside of the barrel; the supporting wall has a distal end that is remote from the shaft portion; the distal end of the supporting wall is located by an outer side of the limit ring and extends into the inner lateral space of the transmission member.

5. The toner cartridge as claimed in claim 3, wherein the transmission member comprises a lateral periphery defining an inner lateral space communicated with an inside of the barrel; the inclined guiding wall has an end portion located by an outer side of the limit ring and extending into the inner lateral space of the transmission member.

6. The toner cartridge as claimed in claim 2, wherein the transmission member comprises a lateral periphery having two protrusion rings abutting against the internal periphery of the barrel, and an outlet located between the two protrusion rings; the toner exit of the barrel is located between the two protrusion rings.

7. The toner cartridge as claimed in claim 6, wherein the lateral periphery of the transmission member has at least one resilient piece located between the two protrusion rings; the toner exit of the barrel is disposed with a toner guiding member extending into a space between the two protrusion rings of the transmission member.

8. The toner cartridge as claimed in claim 1, wherein the toner conveying shaft is driven by the transmission member to rotate relative to the barrel.

9. The toner cartridge as claimed in claim 8, wherein the transmission member is provided at an inner side thereof with at least one inner drive portion; the toner conveying shaft is provided with at least one driven portion abutted with the inner drive portion.

10. The toner cartridge as claimed in claim 8, wherein the transmission member is provided at an outer side thereof with at least one outer drive portion.

11. The toner cartridge as claimed in claim 1, wherein the toner conveying shaft is rotatably disposed to the transmission member.

12. The toner cartridge as claimed in claim 11, wherein the toner conveying shaft is provided at an end thereof with a protrusion axle extending into an axle coupling portion of the transmission member.

13. The toner cartridge as claimed in claim 1, wherein the toner conveying shaft is provided with at least one conveying blade for moving the toners inside the barrel toward the opening of the barrel.

14. The toner cartridge as claimed in claim 1, wherein the transmission member blocks the opening of the barrel.

* * * * *